United States Patent [19]

Batts

[11] 4,068,619

[45] Jan. 17, 1978

[54] ASSEMBLY FOR APPLYING LIQUID TO ELONGATED MATERIAL

[75] Inventor: Robert Lee Batts, Denison, Tex.

[73] Assignee: Johns-Manville Corporation, Denver, Colo.

[21] Appl. No.: 638,014

[22] Filed: Dec. 5, 1975

[51] Int. Cl.[2] ..... B05C 11/02

[52] U.S. Cl. ..... 118/122; 118/103; 118/126; 118/420; 427/434 D

[58] Field of Search ..... 118/419, 420, DIG. 19, 118/DIG. 22, 122, 126, 103; 427/434 R, 434 A, 434 D; 156/100; 68/205 R

[56] References Cited

U.S. PATENT DOCUMENTS

| | | | |
|---|---|---|---|
| 67,881 | 8/1867 | Kendall | 118/DIG. 19 |
| 1,753,447 | 4/1930 | Seidell et al. | 118/103 |
| 2,066,780 | 1/1937 | Holt | 118/126 X |
| 2,372,248 | 3/1945 | Bouton | 118/122 X |
| 2,383,505 | 8/1945 | Lyle et al. | 427/434 D |
| 2,665,660 | 1/1954 | Olden | 118/126 X |
| 2,867,891 | 1/1959 | Horton et al. | 427/434 D X |

FOREIGN PATENT DOCUMENTS

| | | | |
|---|---|---|---|
| 620,569 | 10/1935 | Germany | 118/DIG. 19 |
| 847,183 | 9/1968 | United Kingdom | 427/434 A |

*Primary Examiner*—Mervin Stein
*Attorney, Agent, or Firm*—Robert M. Krone; Joseph J. Kelly; Stephen C. Shear

[57] ABSTRACT

An assembly for applying liquid material, for example, liquid resin, to elongated material, for example glass fiber strands, is disclosed herein. This assembly includes means for maintaining a supply of the liquid resin in a container and transferring some of it from the container to a stationary, preferably flat, surface which is positioned out of direct contact with the resin supply. The glass fiber strands are moved over the stationary surface and through the liquid resin thereon.

1 Claim, 3 Drawing Figures

ASSEMBLY FOR APPLYING LIQUID TO ELONGATED MATERIAL

BACKGROUND OF THE INVENTION

The present invention relates generally to the application of liquid material to elongated material and more particularly to an assembly for coating or impregnating strands of material, for example glass fiber strands, with liquid resin.

As will be seen hereinafter, the present invention is directed specifically to the "wetting out" or impregnation of glass fiber strands with liquid resin in the manufacture of glass reinforced plastic pipe. There are however numerous manufacturing operations which require applying a liquid, for example liquid resin, to elongated material, for example glass fibers either in strand or single element form. As a result, there are numerous wet out or impregnation techniques in the prior art.

One typical resin impregnating technique calls for passing the material to be impregnated directly through a bath of resin. There have been several different ways to accomplish this. One method, which has been referred to as the "funnel and plug" method calls for moving the material, for example the glass filaments or strands, into a funnel filled with the resin and out through the bottom of the funnel past a plug. Another method calls for dipping the fibers or filaments into and out of a bath of resin utilizing dip rollers to guide the fibers.

While the funnel and plug method is uncomplicated in that it requires few if any moving components in the resin bath itself, this method has several disadvantages. For example, it is difficult to control wet out or resin impregnation and generally more than the desired amount of resin is placed on the fibers or filaments. The dip method using rollers in the bath itself also has many disadvantages. One major disadvantage using this method is that it is quite difficult to thread the fibers or filaments, either initially or after a break. In addition, in the event one or more fibers or filaments break during operation, these broken fibers have the tendency to wrap around the moving rolls. This "roll wrap" problem as it is commonly referred to can result in the entire resin impregnating system being shut down for relatively long periods of time.

Another and probably more commonly used method of applying resin to fibers may be referred to as the "transfer" technique. In accordance with this technique generally, one or more rollers are used to transfer resin from a bath to the fibers. Either the resin is transferred directly from one roller onto the moving fibers in contact with the roller or it is transferred via a series of rollers and ultimately onto the moving fibers in contact with the last roller in the chain. There are a number of specific techniques of this general type as exemplified by the following patents:

U.S. Pat. No. 2,728,972,
U.S. Pat. No. 2,873,718,
U.S. Pat. No. 2,968,278,
U.S. Pat. No. 2,157,212,
U.S. Pat. No. 3,244,143,
U.S. Pat. No. 2,118,517,
U.S. Pat. No. 3,082,734,
U.S. Pat. No. 2,868,162,
British patent Specification No. 1,273,377,
Canadain Pat. No. 712,090.

In all of these patents, the material being coated or impregnated moves into contact with a moving surface, in most cases a moving drum or roller. This moving surface, for example the drum, transfers the liquid coating onto the moving material to be coated or impregnated. There are a number of drawbacks with this general transfer method and the many specific transfer methods disclosed in the prior art. One major disadvantage is that it is highly susceptible to the roll wrap problem discussed above.

As will be seen hereinafter, the present invention, in its preferred embodiment, is also directed to wetting out or impregnating fibrous material, particularly glass fiber strands, with liquid resin. However, as will also be seen hereinafter, the manner in which this is accomplished is entirely different than the methods discussed above and does not have many of the drawbacks associated with these prior art methods.

SUMMARY OF THE INVENTION

An object of the present invention is to provide a an assembly for applying liquid material to elongated material, particularly liquid resin to individual fibers or fiber strands in a more reliable and economical manner than has heretofore been provided.

Another object of the present invention is to provide this assembly in a way which minimizes and preferably eliminates the roll wrap problem discussed above.

Still another object of the present invention is to control accurately the amount of liquid material, specifically resin, applied to the elongated material, specifically the fibers or fiber strands and thus minimize liquid material waste.

In accordance with the present invention, a supply of liquid material, specifically liquid resin in the actual working embodiment of the present invention, is maintained in a container. Some of this resin is transferred from the container onto a static or stationary surface which is out of direct contact with the supply of resin in the container. Elongated material, actually a number of glass fiber strands in the actual working embodiment of the present invention, are moved over the flat surface and in contact with the resin.

As will be seen hereinafter, in a preferred and actual working embodiment of the present invention, the stationary resin receiving surface is substantially flat and positioned at an incline with the horizontal. A rotatably driven roller or drum is positioned at least partially in the container so that a portion of its surface is submerged in the resin supply and a portion, located outside the resin supply, engages one end, the upper end, of the inclined stationary surface. As the roller or drum rotates, resin from within the container passes onto the roller and thereafter onto and down the stationary surface. At the same time, the glass fiber strands are moved over the inclined surface and pressed against it, preferably by a static or stationary press element. As the fiber strands move off the stationary surface they pass through a series of squeeze rods, which in the preferred and actual working embodiment of the present invention are also stationary. In the actual working embodiment of the present invention, the resin impregnated strands are wound around a rotating mandrel or rotating core pipe, ultimately forming a reinforced plastic pipe.

As will be discussed in more detail hereinafter, there are several advantages to the method and assembly just described. First, it has been found that the amount of resin used to coat or impregnate the fibers or fiber strands can be accurately controlled so as to minimize wastage. Second, this method and assembly allow the fibers or fiber strands to be readily threaded through the system, particularly in a way which minimized tension on the fibers. In addition to these advantages, the previously discussed roll wrap problem has been eliminated, at least at the point where the resin is applied to the glass.

DETAILED DESCRIPTION AND PREFERRED EMBODIMENT

Figure 1:
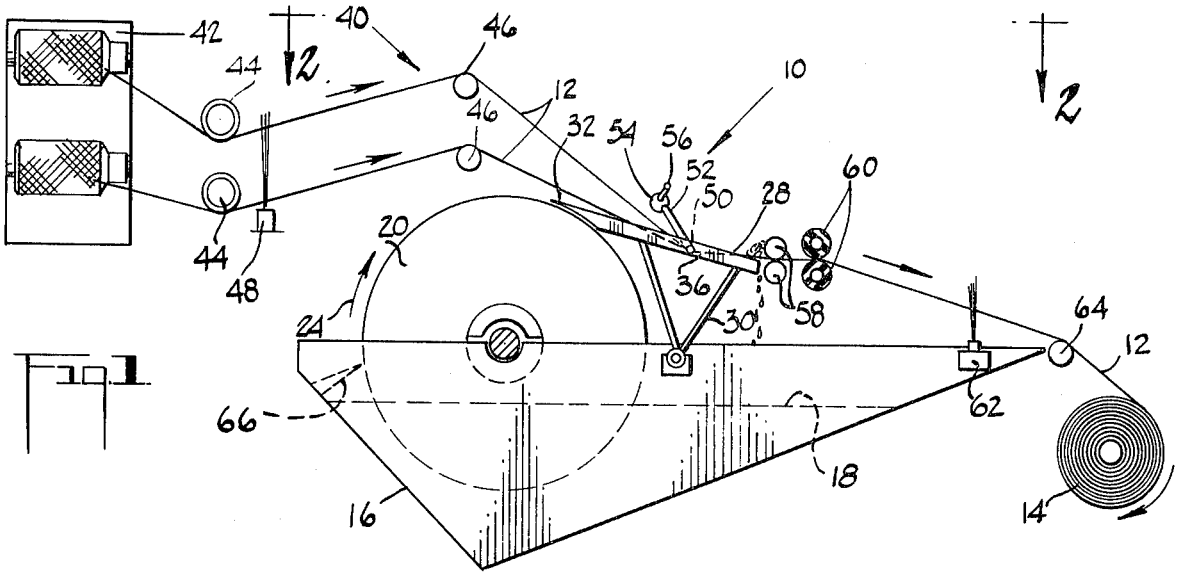
FIG. 1 is a side elevational view, partially schematically illustrated, of an assembly for impregnating fibers or fiber strands with a liquid material, specifically liquid resin, which assembly is constructed in accordance with the present invention.
Figure 2:
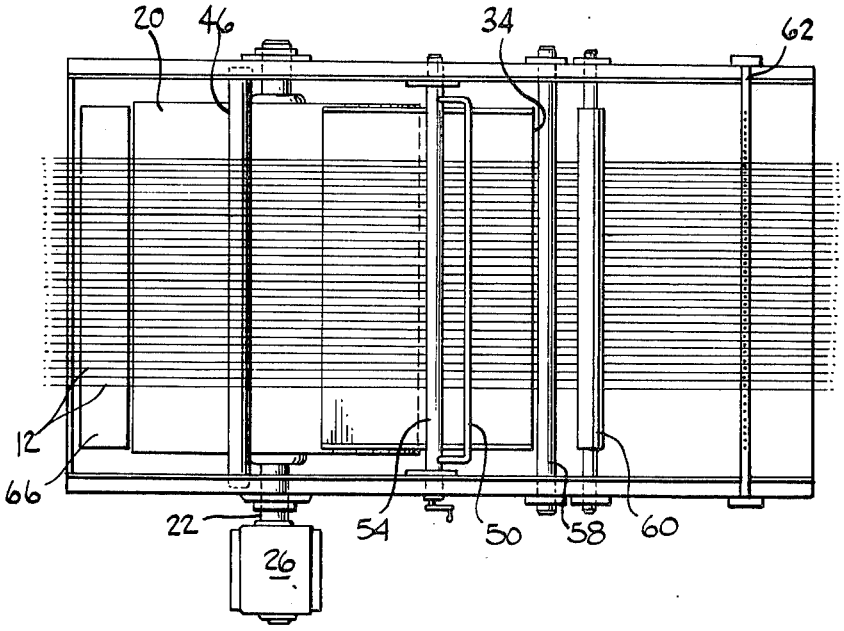
FIG. 2 is a top plan view illustrating a portion of the assembly of FIG. 1.

Turning to the drawing wherein like components are designated by like reference numerals throughout the three figures, an assembly constructed in accordance with the present invention is illustrated and generally designated by the reference numeral 10. As will be described hereinafter, this assembly is provided for wetting out or impregnating glass fiber strands, generally designated by the reference numeral 12, with a liquid resin material, for example an epoxy resin. After being impregnated with the resin, these strands are wrapped around a mandrel or cylindrical pipe core designated at 14, ultimately to form a glass fiber reinforced plastic pipe generally.

As illustrated best in FIG. 1, assembly 10 includes a container or tub 16 opened at its top and having a supply of resin therein, the resin being generally designated at 18. A cylindrical drum or roller 20 is positioned at least partially within tub 16 so that a portion of its outer cylindrical surface is submerged in the supply of resin and so that another portion of this surface is outside the resin. Drum 20 is mounted for rotation about its own axis by suitable means such as, for example, shaft 22 and is driven in the direction of arrow 24 by suitable means such as motor 26. For reasons to be discussed hereinafter, motor 26 is preferably a variable speed motor.

Assembly 10 also includes a stationary or fixed resin tray or plate 28 which is held in place in front of drum 20 by suitable means such as, for example, brackets 30. Tray 28 includes an upstream or rearward end 32, a downstream or forward end 34 and a preferably substantially flat top surface 36 which extends downward at an incline with the horizontal from upstream end 32 to downstream end 34, as best illustrated in FIG. 1. The degree of incline of tray 28 depends upon the desired speed at which the resin, transferred to its surface, is to pass along the surface. This of course, depends on the viscosity of the resin. In an actual working embodiment of the present invention, the tray is inclined at a 10° angle with the horizontal. To confine this resin as it moves the tray may include sidewalls indicated at 27.

Tray 28 is positioned above container 16 so that end 32 is in slideable engagement with drum 20 at the front or upstream unsubmerged side of the drum. As will be seen hereinafter, as drum 20 rotates in the direction of arrow 24, it picks up some of the resin in tub 16 and transfers this resin on to surface 36 of the plate 28 via end 32. End 32 is of course contoured to pick up the resin from the drum surface as the latter rotates. As will also be seen, the resin transferred to surface 36 moves down the surface to impregnate glass fiber strands 12.

As seen best in FIG. 1, assembly 10 includes an arrangement 40 for guiding glass fiber strands 12 from a glass fiber strand supply, generally indicated at 42, over drum 20, over and against surface 36 of tray 28 and finally to a point where the, strands are wound around mandrel or core pipe 14. Inasmuch as strand supply 42 delivers two levels of glass fiber strands in the embodiment illustrated, arrangement 40 includes two pairs of horizontally extending and vertically aligned guide rods, designated at 44 and 46 respectively. As shown in FIG. 1, the upper layer and lower layer of glass fiber strands pass under guide rods 44 which are located adjacent supply 42 and pass over guide rods 46 which are spaced above drum 20. A fiber separating comb, generally designated at 48, is located between the two pair of guide rods to maintain the individual fibers or fiber strands separated from one another. While guide rods 44 and 46 may be of the rotating type, they are preferably static or stationary. Hence, if a fiber strand 12 breaks at one or more of these guide rods, it will not wrap around it as the remaining strands move on.

Figure 3:
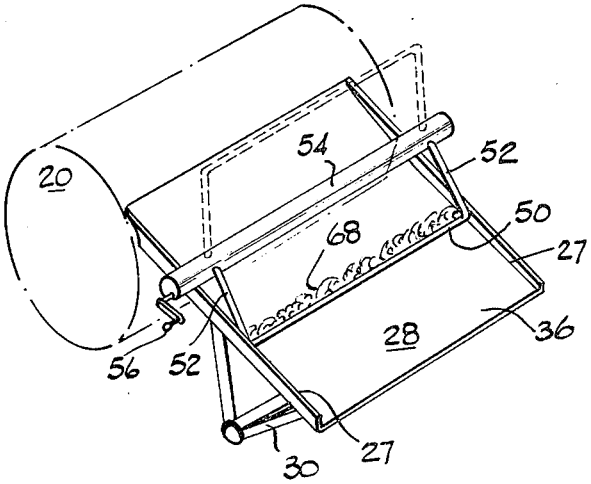
FIG. 3 is a perspective view illustrating certain features of the assembly of FIGS. 1 and 2.

As illustrated best in FIG. 3, arrangement 40 also includes a horizontal press bar 50 which is located above and which extends at least partially across top surface 36 of plate 28 near end 32 of the plate. As seen in FIG. 3, cross bar 50 extends between and is connected with two press bar support members 52 which are connected to a cross bar 54. Cross bar 54 is rotatably mounted to support press bar 50 between an operating or pressing position, as illustrated by solid lines in FIG. 3, and an inoperative or nonpressing position, as illustrated by dotted lines in the same figure. A handle, indicated at 56, may be provided for moving the press bar between its operative and inoperative position.

Returning to FIG. 1, it can be seen that press bar 50 is shown in its operative position against surface 36 of plate 28. In this position, the two layers of glass fiber strands 12, having passed over rollers 46, merge under the press bar and are pressed against surface 36. In this regard, cross bar 54 can be rotatably mounted utilizing for example a ratchet mechanism so that the amount of pressure exerted against surface 36 by press bar 50 is adjustable. However, in accordance with a preferred embodiment of the present invention, cross bar 54 is mounted for free rotation between the operative and inoperative positions of press bar 50 so that the weight of the press bar determines the amount of pressure it exerts against surface 36. Only a minimum amount of pressure is sufficient to maintain the fiber strands against or in very close proximity to surface 36 is necessary. For reasons to be discussed hereinafter, press bar 50 in its operative or pressing position is static or stationary, that is, it does not rotate or otherwise move as fiber strands 12 move between it and plate 28.

Glass fiber strands 12, after moving under press bar 50 and in close proximity to but preferably against surface 36 of plate 28, are maintained in a position in close proximity to or against surface 36 along the entire length of the surface by two pairs of squeeze rods 58 and 60, respectively. As seen in FIG. 1, squeeze rods 58 are vertically aligned with one another and are located adjacent forward end 34 of plate 28 over container 16. Squeeze rods 60 are also vertically aligned with one another and are located directly in front of rods 58. As the fiber strands 12 move off of surface 36 beyond end 34 of plate 28 they pass between squeeze rods 58 and then between squeeze rods 60. The squeeze rods 58 are sufficiently close to one another and the squeeze rods 60 are sufficiently close to one another so as to apply squeezing forces against the fiber strands as they pass therebetween. While the fiber contacting surfaces of rods 58 and 60 may be constructed of any suitable material, the contacting surfaces of rods 58 are preferably constructed of a hard nonporous material, for example metal, and the contacting surfaces of rods 60 are preferably constructed of a somewhat softer surface, for example rubber. The reason for this is that squeeze rods 58 are provided to remove excess resin from the fiber strands and squeeze rods 60 are provided for embedding some of the resin on the surface of the strands into the strands. Like guide rods 44 and 46 and press bar 50, squeeze rods 58 and 60 are preferably stationary or static, that is, they do not roll or otherwise move as the fiber strands move between them.

After moving through the squeeze rods 58 and 60, the resin embedded fiber strands move through a second fiber separating comb, generally designated at 62, and over another preferably stationary or static guide rod 64 and finally around mandrel over core 14.

As described above, arrangement 40 includes a number of specific components for guiding glass fiber strands 12 over and against surface 36 of plate 28 as the strands move in the direction of mandrel or core pipe 14. In the embodiment illustrated, these components have included guide rods 44, 46 and 64, fiber separating combs 48 and 62, squeeze rods 58 and 60 and press bar 50. It is to be understood that the present invention is not limited to this particular arrangement of components. For example, arrangement 40 may require more or less guide rods, more or less separating combs and more or less squeeze rods depending upon the path taken by the fiber strands. In addition, the exact positioning of these components will depend in large part on the path taken by the fiber strands. However, because of the manner in which the strands are impregnated, this path does not have to include sharp bends or turns and in accordance with the present invention it does not include sharp turns, for example 90° bends in the moving strands. This allows the strands to be moved at relatively high speeds, for example, 150 ft/minute, with little tension on the strands, for example, 0.5 lbs. per strand.

Moreover, while it has not been shown exactly how the guide rods, fiber separating combs and squeeze rods are supported in the positions illustrated, it is to be understood that they are supported in a suitable and conventional manner. However, in accordance with a preferred and actual working embodiment of the present invention, all of the components which do come in direct contact with the fiber strands, for example, the guide rods, squeeze rods and the like, as the strands move between supply 42 and mandrel 14 are stationary. This, as stated previously, eliminates the possibility of roll wrap resulting from broken strands.

It is also to be understood that the present invention is not limited to the particular configuration of press bar 50 and its support components. It is sufficient to say that any suitable means, preferably static or stationary means, for pressing strands 12 into the resin on surface 36, preferably against surface 36 of plate 28, may suffice.

Having described assembly 10, attention is now directed to the method in which this assembly is used to impregnate glass fiber strands 12 with resin 18. Initially, strands 12 are feed manually under rollers 44 through comb 48 and over rollers 46. They are then moved under press bar 50 between the press bar and surface 36 of plate 28 and thereafter through the squeeze roller 58 and 60, through separating comb 62 and over guide rod 64. The free ends of strands 12 are then attached to mandrel or core pipe 14 which, when rotating, provides the moving force for the strands.

As the strands move toward the mandrel from supply 42, drum 20 is rotated in the direction of arrow 24 at a predetermined speed which will determine the amount of resin to be delivered to surface 36 during any given period of time. As stated previously, drum 20 is preferably driven by a variable speed motor which can be used to regulate the amount of resin applied to surface 36. As the drum rotates some of the resin in the container is transferred to the surface of the roller and, as stated previously, delivered to the back end 32 of surface 36. A doctor blade generally positioned at 66 may be suitably positioned and mounted in container 16 and against the surface of drum 20 directly above the supply of resin 18 to remove excess resin on the drum.

The resin which is transferred to surface 36 at end 32 moves down the surface towards end 34 under press roller 50. However, as illustrated best in FIG. 3, a transverse bead of this material does accumulate behind the press bar, as indicated at 68. As the strands move across surface 36, complete impregnation or wet out is assured, by means of bead 68. However, as the strands move across the surface they are continuously impregnated by the resin moving down the surface. As the resin impregnated and coated strands move between squeeze rollers 58, excess resin from the surface of the strands is removed and, as indicated at 70, falls back into container 16 along with any excess resin passing off end 34 of surface 36. The strands then move between squeeze rollers 60 so that much of the surface resin is squeezed into the strands. Finally, the strands move through comb 62 and over guide rod 64 and finally around mandrel or core pipe 14.

The method just described is one which allows for resin impregnation or wet out to be accurately controlled and one which eliminates the aforedescribed roll wrap problem. As a result, this method minimizes resin wastage and minimizes operating downtime. It also allows the fiber strands to move along a path which is relatively straight, at least a path which does not necessarily include sharp turns, even at the point or points of resin impregnation. As a result, the strands can be moved relatively fast with relatively low tension being applied thereto. While this method, as described, is part of an overall manufacturing process for making tubular material, it is to be understood that the present invention is not limited to this particular overall process. The method and assembly disclosed herein can be used for applying liquid material generally to moving elongated material generally whatever the ultimate intended use of the elongated material.

What I claim is:

1. An assembly for applying a liquid resin material to fibers, said assembly comprising:

a. a container having therein a supply of said resin;

b. a rotatably mounted roller at least partially located within said container, a portion of said roller being submerged within said supply of resin and a portion being located outside said supply;

c. means including a stationary substantially flat surface having one end in engagement with an unsubmerged portion of said roller and an opposite end spaced from and out of engagement with said roller, said flat surface being at an incline with the horizontal such that said spaced end is below said roller engaging end;

d. means for rotating said roller such that some of the resin in said container moves onto said roller and from said roller onto said flat surface; and e. means supporting said fibers for movement over and against said flat surface through the liquid resin on said surface, whereby to coat said fibers with said resin, said supporting means including stationary means for pressing said moving fibers against said surface and in said resin, said fibers supporting means further including i. a first pair of adjacent stationary squeeze rods located adjacent to but spaced from said spaced end of said flat surface and a second pair of adjacent stationary squeeze rods located between said first pair of rods and the spaced end, said squeeze rods being positioned such that said fibers, after being coated with said resin, pass through and are squeezed by each of said pair of rods and said first pair of rods including squeezing surfaces constructed of material of predetermined hardness and wherein said second pair of rods includes squeezing surfaces constructed of material harder than the material of said first pair, and ii. a number of means in direct contact with said fibers, all of said direct contacting means being stationary.

* * * * *